US010335665B1

(12) United States Patent
Ritter

(10) Patent No.: US 10,335,665 B1
(45) Date of Patent: Jul. 2, 2019

(54) SPLITBOARD LATCHING DEVICE

(71) Applicant: Spark R&D IP Holdings, LLC, Bozeman, MT (US)

(72) Inventor: William J Ritter, Bozeman, MT (US)

(73) Assignee: SPARK R&D IP HOLDINGS, LLC, Bozeman, MT (US)

( * ) Notice: Subject to any disclaimer, the term of this patent is extended or adjusted under 35 U.S.C. 154(b) by 0 days.

(21) Appl. No.: 15/877,415

(22) Filed: Jan. 23, 2018

(51) Int. Cl.
*A63C 5/03* (2006.01)
*E05B 65/08* (2006.01)

(52) U.S. Cl.
CPC ..... *A63C 5/033* (2013.01); *A63C 5/031* (2013.01); *A63C 2203/06* (2013.01); *E05B 65/0811* (2013.01)

(58) Field of Classification Search
CPC ..... A63C 5/02; A63C 5/032; A63C 2203/06; E05C 3/30; E05C 3/002; E05C 19/105; E05C 19/145; A47B 87/002; E05B 65/0811
See application file for complete search history.

(56) References Cited

U.S. PATENT DOCUMENTS 120,192 A * 10/1871 Greenough ..... E05C 3/046 292/240
135,873 A * 2/1873 Youngblood ..... E05C 3/046 292/240
212,487 A * 2/1879 Morris ..... E05B 65/0007 292/210
296,402 A * 4/1884 Goforth ..... E05B 65/0811 292/101
621,318 A * 3/1899 Brachhausen ..... E05B 65/0811 292/101
1,513,234 A * 10/1924 Ignaz ..... E05C 19/10 292/101
1,926,949 A * 9/1933 Kennedy ..... F16L 37/16 285/320
1,943,927 A * 1/1934 Phillips ..... E05B 83/243 292/101
3,811,718 A * 5/1974 Bates ..... E05C 3/045 292/241

(Continued)

OTHER PUBLICATIONS

Hoss Hooks, Prowder Website, accessed on the Internet at https://www.prowder.com/product/hoss-hooks/ on Jan. 17, 2018.

(Continued)

*Primary Examiner* — Emma K Frick
(74) *Attorney, Agent, or Firm* — Stone Creek Services LLC; Alan M Flum

(57) ABSTRACT

A latching device that can latch two splitboard skis together over their lengthwise common edge. The latching device accommodates variation in the distance between latching device mounting holes. The latching device rotates about a fastener assembly secured through one of the latching device mounting holes through the first of the two splitboard skis. A slot in the latching device, engages a second fastener assembly by tension between the outside edge of the slot and the lengthwise common edge between the splitboard skis. The slot includes a series of detents that can engage the second fastener assembly. The detents are distanced progressively closer to the axis of rotation of the latching device to accommodate various distances between the first mounting hole and the second mounting hole.

17 Claims, 8 Drawing Sheets

(56) References Cited

U.S. PATENT DOCUMENTS

| | | | | | |
|---|---|---|---|---|---|
| 5,182,996 | A * | 2/1993 | Gutgsell | A47B 87/002 | 108/64 |
| 5,551,728 | A * | 9/1996 | Barthel | A63C 5/02 | 280/14.1 |
| 5,649,722 | A * | 7/1997 | Champlin | A63C 5/02 | 280/14.22 |
| 5,660,416 | A * | 8/1997 | Schiele | A63C 5/031 | 280/14.21 |
| 5,984,324 | A * | 11/1999 | Wariakois | A63C 5/02 | 280/14.24 |
| 6,464,423 | B1 * | 10/2002 | Klein | A47B 87/002 | 292/101 |
| 6,523,851 | B1 * | 2/2003 | Maravetz | A63C 5/02 | 280/14.22 |
| 8,708,371 | B2 * | 4/2014 | Balun | A63C 5/033 | 280/14.21 |
| 9,132,336 | B2 | 9/2015 | Bulan | | |
| 9,227,131 | B2 | 1/2016 | Adamczewski | | |
| 9,238,168 | B2 | 1/2016 | Kloster et al. | | |
| 9,795,861 | B1 | 10/2017 | Kloster et al. | | |
| 9,821,214 | B2 | 11/2017 | Browning | | |
| 10,029,165 | B2 * | 7/2018 | Kloster | A63C 5/02 | |
| 10,252,146 | B2 * | 4/2019 | Ritter | A63C 5/02 | |
| 2015/0014962 | A1 | 1/2015 | Rayner | | |
| 2015/0157920 | A1 * | 6/2015 | Adamczewski | A63C 5/033 | 280/601 |

OTHER PUBLICATIONS

Voile Tip Clip Template, Nov. 2013, Voile Manufacturing, Salt Lake City, Utah.

Voile Split Kit Instructions, Sep. 2013, p. 4, Voile Manufacturing, Salt Lake City, Utah.

Voile Tip Clips, accessed on the Internet at http://www.voile.com/voile-tip- clips.html on Jan. 17, 2018.

New Tip/Tail Clips, Karakoram, accessed on the Internet at https://www.splitboardbindings.com/2011/04/26/new-tiptail-clips/ on Jan. 17, 2018.

Table Leaf Fastener (Image), accessed on the Internet at https://woodcraft- production-weblinc.netdna-ssl.com/product_images/table-leaf-fasteners-2- pair/584576c269702d19380004e1/zoom.jpg?c=1480947394 on Jan. 17, 2018.

Table Connector, for Screw Fixing Beneath Table Top, Zinc Alloy and Plastic, accessed on the Internet at https://www.hafele.co.uk/en/product/table-connector-for-screw-fixing-beneath- table-top-zinc-alloy-and-plastic/000000190002f04a00010023/ on Jan. 17, 2018.

Plako Table Connector "Steel," Brochure, Feb. 2012, Plako GmbH, Germany.

Lorell Training Table Metal Connector, Office Depot website, accessed from the Internet at https://www.officedepot.com/a/products/355959/Lorell-Training- Table-Metal-Connector-46/ on Jan. 18, 2018.

Striplox Simple Strong Secure, Catalog, May 2017, Joinlox, Brisbane, Austraila.

* cited by examiner

SPLITBOARD LATCHING DEVICE

BACKGROUND

The present disclosure relates to devices for latching splitboard skis together. A splitboard is a snowboard separable into re-joinable skis.

Snowboarding is a recreational activity where a rider glides down a snow-covered mountain, hill, or slope while standing with their feet attached to a single snow glide board known as a snowboard. The concept is like snow skiing except both feet are attached to a single board.

Snowboard riders or "snowboarders" often share downhill slopes with skiers. Popular downhill slopes are often accessed by ski lifts to take the skier or snowboarder up to the top of the slope. Some snowboarders are interested in accessing downhill slopes in the backcountry away from crowded ski slopes and where the snow is fresh. However, climbing up mountains and slopes with thick fresh soft snow can be challenging.

Splitboards were developed to allow snowboarders access to the backcountry and areas not normally accessible to snowboarders. To climb uphill, or "tour," the backcountry, in "touring mode," the splitboard rider separates the splitboard into separate splitboard skis and uses them like cross-country skis. To ride downhill, in "riding mode," the splitboard rider rejoins the splitboard skis and rides the splitboard as they would an ordinary snowboard.

Boot bindings hold the splitboard rider's boots to the splitboard. In touring mode, one boot binding is attached to each splitboard ski like cross-country skis. In riding mode, the boot bindings are fastened across the splitboard skis and hold the splitboard skis together.

Latching devices placed along the length of the seam between the two splitboard skis help increase torsional stiffness and reduce flexing of the splitboard skis relative to each other. Latching devices positioned near the forward tip, or nose, and rearward tip, or tail, prevent the splitboard from separating at these points. Latching devices take various forms such as buckles or hook clips. These latching devices go by various names in the splitboard trade, depending on their structure and placement; for example, splitboard clips, tip and tail clips, splitboard hooks, and split hooks.

SUMMARY

The inventor noticed a problem with splitboard latching devices. There can be variation in the distance between the apertures used to secure the latching device to each splitboard ski. This creates variation in the tension or holding force between the splitboard skis and can affect performance. The inventor developed a latching device to address this issue. The latching device can be positioned over the lengthwise common edge between the splitboard skis. The latching device accommodates variation in the distance between the latching device mounting holes. The latching device rotates about a fastener assembly secured through one of the latching device apertures on the first of the two splitboard skis. A slot in the latching device, engages a second fastener assembly by tension between the outside edge of the slot and the lengthwise common edge between the splitboards. The slot includes a series of detents that can engage the second fastener assembly. Each successive detent is distanced progressively closer to the axis of rotation of the latching device to accommodate various distances between the first mounting hole and the second mounting hole.

The detents can be shaped like the arc of a cylinder. This arc can have the same radius as the portion of the second fastener assembly that engages the detents (i.e., the detents are complementary in shape with the detent engaging portion). The inventor found this size and shape creates sufficient holding force so the latch does not slip or unlatch during normal operation of a splitboard while still allowing the splitboard rider to rotate the latching device. The inventor envisions that other detent shapes can be used if they can prevent the latch from slipping or unlatching during normal operation of the splitboard but still allow the splitboard rider to unlatch the board.

The slot can extend through a first side of the latching device. This allows the latching device to rotate away from the second fastener assembly and from a latched position to an unlatched position. The first side can include a first side portion that projects upward from the slot. The first side portion can provide additional mechanical support for the latching device. The splitboard rider can use the first side portion as a handle for rotating the latching device.

The surface surrounding the slot can be indented from the top surface of the latching device. This raises up the sides so that the splitboard rider has a convenient place to grasp, push, or pull on the latching device to rotate it even while wearing gloves. It is well within the scope of a latching device to have the surface surround the slots be not indented from the top surface.

This Summary introduces a selection of concepts in simplified form described the Description. The Summary is not intended to identify essential features or limit the scope of the claimed subject matter.

DRAWINGS

DESCRIPTION

The terms "top, "bottom," "upper," "front," and "back," are relative terms used throughout the to help the reader understand the figures. Unless otherwise indicated, these do not denote absolute direction or orientation and do not imply a preference. When describing the figures, the terms "top," "bottom," "front," "rear," are from the perspective of how a typical splitboard rider would view the splitboard or components while standing on the board in a conventional riding or touring position. Specific dimensions should help the reader understand the scale and advantage of the disclosed material. Dimensions given are typical and the claimed invention is not limited to the recited dimensions. The figures are not necessarily to scale.

Certain features or components and some details of conventional elements may not be shown in the interest of clarity, explanation, and conciseness. For example, a splitboard may include bindings for securing the rider's feet to the splitboard. The splitboard may also include hardware associated with the bindings such as pucks, tracks, sliders, and climbing bars. These parts are omitted for clarity. In the present disclosure, they represent part of the environment and one of ordinary skill in the art ready knows how to apply them to a splitboard.

Referring to similarly named part with an ordinal prefix such as first, second, or third helps distinguish the parts from one another when referred to together. This implies no preference of one part over the other. Similarly, referring to examples using ordinal prefixes or as alternative examples, does such not infer any preference of one example over the other.

The Description refers to figures, where like numerals refer to like elements throughout the several views.

Figure 1:
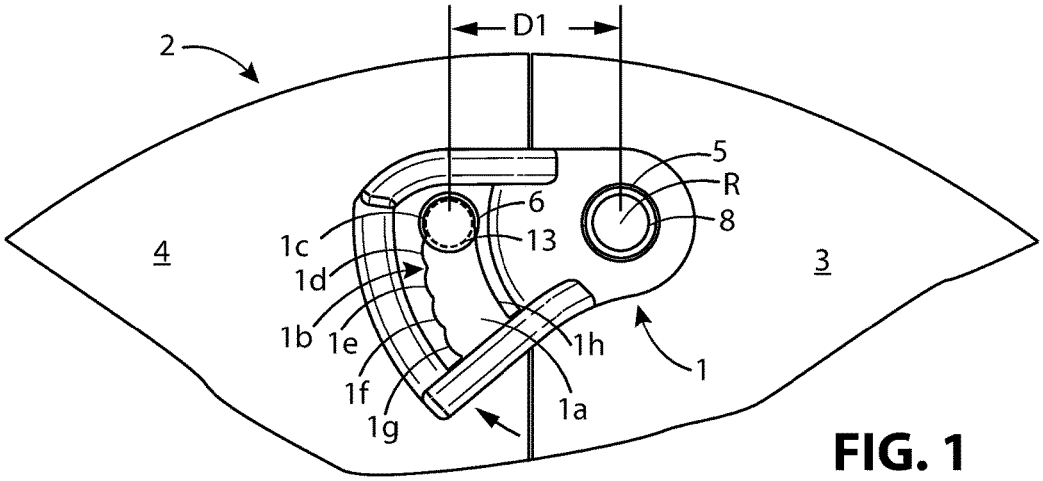
FIG. 1 illustrates, in top view, a portion of the splitboard with the latching device rotated fully counter clockwise to accommodate threaded fastener assemblies separated by a distance D1.
Figure 2:
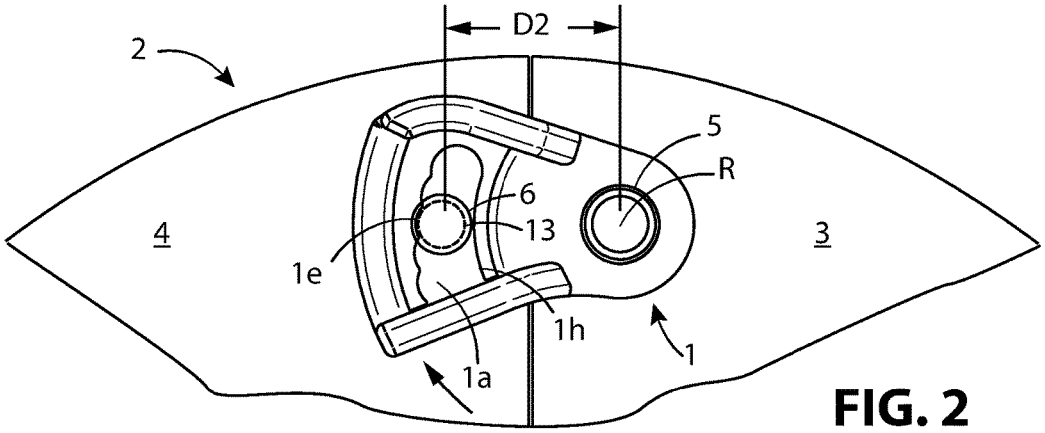
FIG. 2 illustrates, in top view, the portion of the splitboard from FIG. 1 with the latching device rotated clockwise to accommodate threaded fasteners separated by a distance D2.
Figure 3:
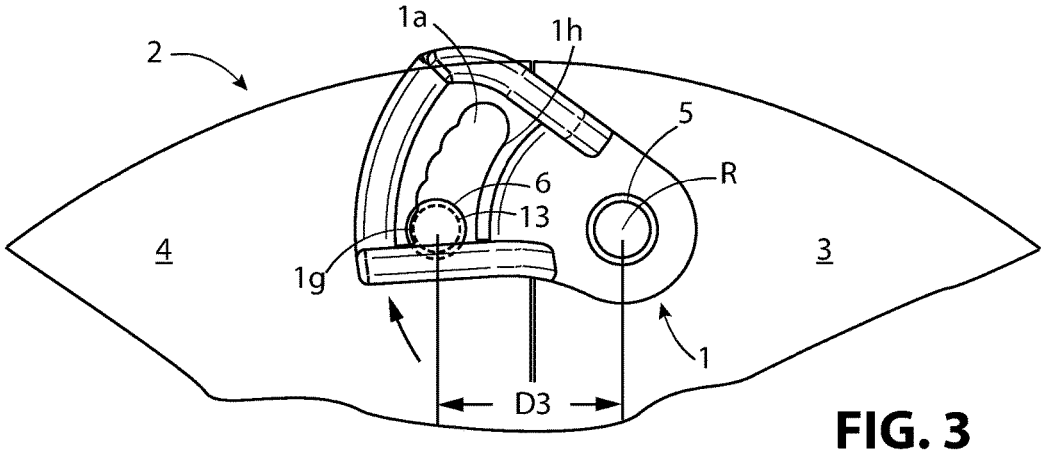
FIG. 3 illustrates in top view, the portion of the splitboard from FIG. 1 with the latching device rotated fully clockwise to accommodate threaded fasteners separated by a distance D3.
Figure 4:
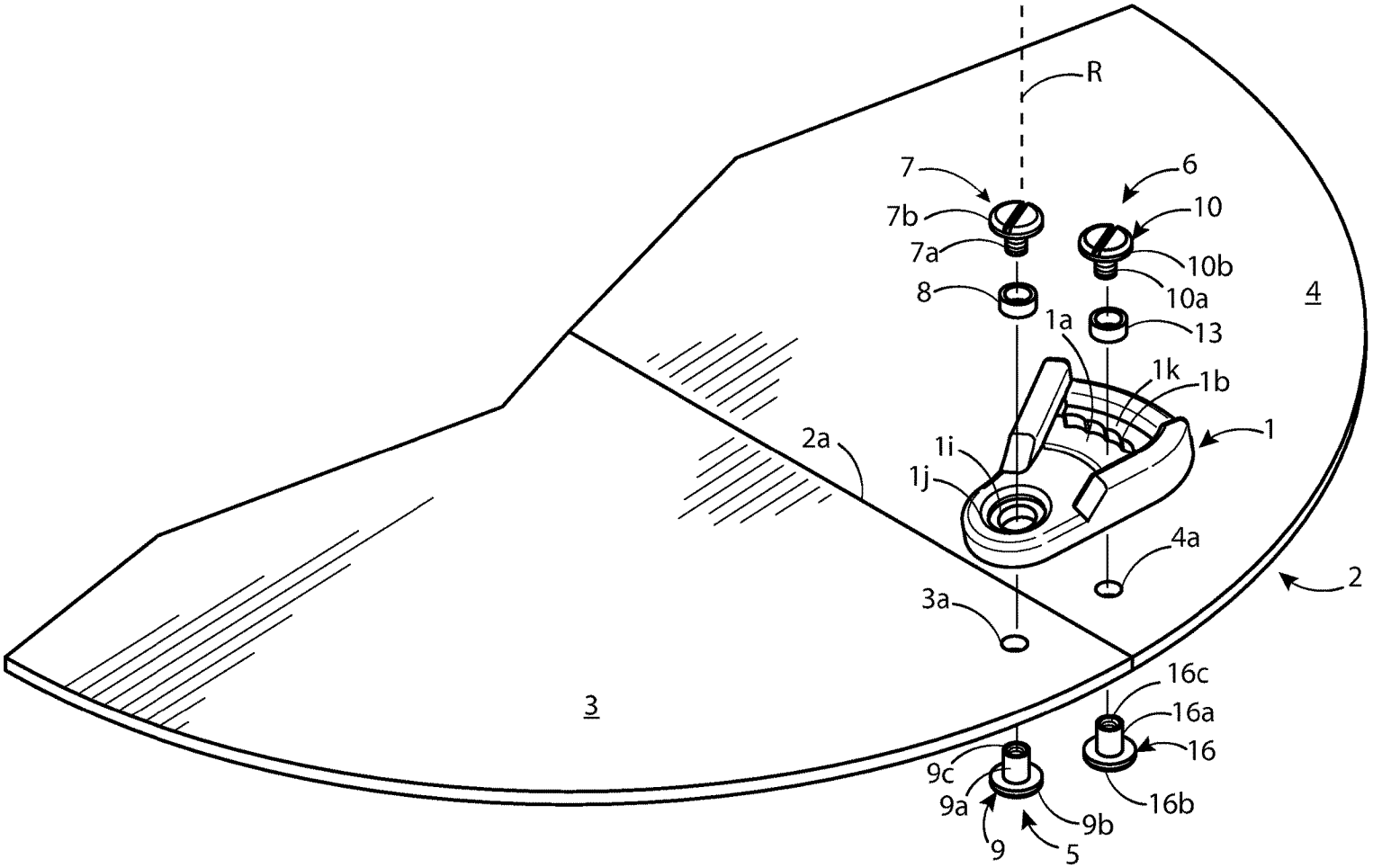
FIG. 4 illustrates, in exploded perspective view, the latching device, associated mounting hardware, and a portion of the splitboard.

The inventor noticed that one problem with latching devices, and particularly latching devices that join splitboards is that apertures spaced apart that hold the latching device can have variation in their distance relative to each other. For example, the inventor observed, that for a nominal distance of 1 inch (0.0254 m) between the mounting aperture on a first splitboard ski and the aperture on the second splitboard ski, the positional variation between the aperture can typically be up to 0.08 inches (0.00203 m). The inventor developed a latching device 1 illustrated in FIGS. 1-15 to address this issue. FIGS. 1-4, illustrate the latching device 1 and a portion of a splitboard 2, with the latching device 1 positioned over portions of a first splitboard ski 3 and a second splitboard ski 4. Referring to FIG. 4, the latching device 1 accommodates variation in the distance between a first mounting hole 3*a* through the first splitboard ski 3 and a second mounting hole 4*a* through the second splitboard ski 4. Referring to FIGS. 1-3, the latching device 1 rotates about rotational axis R to accommodate various distances between the first mounting hole 3*a* and the second mounting hole 4*a* both of FIG. 4. In FIGS. 1-3 the distance between the first mounting hole 3*a* and the second mounting hole 4*a* of FIG. 4 is represented as distances D1, D2, D3 respectively. Distance D1 is less than distance D2. Distance D2 is less than distance D3. For example, the difference between D1 and D3 could be 0.08 inches (0.00203 m) to accommodate typical positional variations. With five detents (i.e., four increments) this would allow for a positional variation between each detent of 0.02 inches (0.000508 m).

Referring to FIG. 4, the latching device 1 rotates around a first fastener assembly 5 centered on a rotational axis R through the first mounting hole 3*a* in the first splitboard ski 3. A slot 1*a* in the latching device 1 engages a second fastener assembly 6 by tension between the outside edge 1*b* of the slot 1*a* (i.e., the edge of the away from the rotational axis R) and the lengthwise common edge 2*a* of the splitboard 2.

Figure 5:
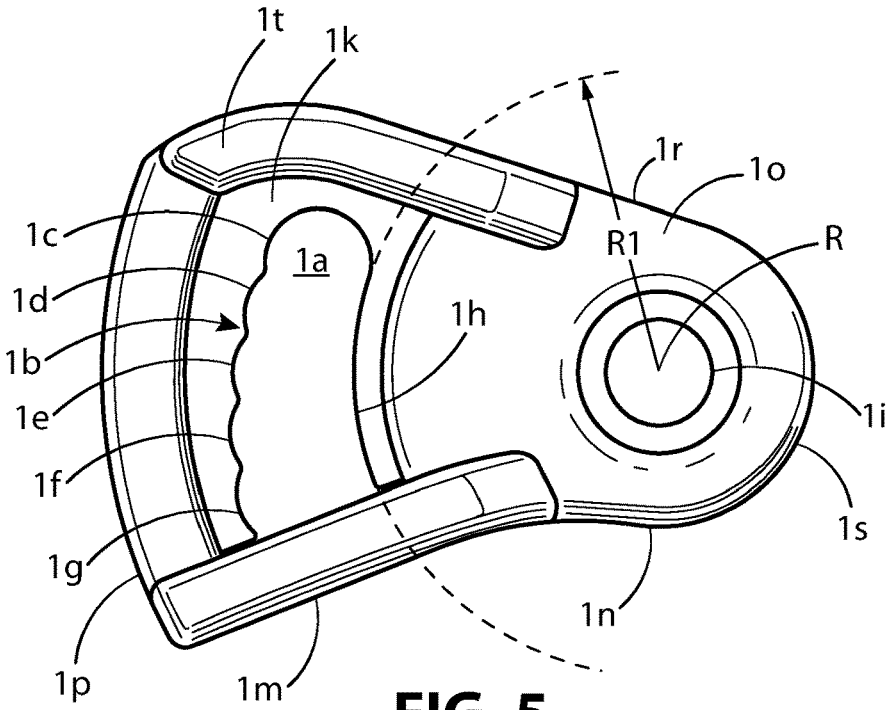
FIG. 5 illustrates the latching device in top view.

Referring to FIGS. 1 and 5, the outside edge 1*b* of the slot 1*a* include detents 1*c*, 1*d*, 1*e*, 1*f*, 1*g*. The from bottom to the top of the slot, the detents 1*g*, 1*f*, 1*e*, 1*d*, 1*c* that get progressively closer to the axis of rotation R. Detent 1*c* is closer to the axis of rotation than detent 1*d*. Detent 1*d* is closer to the axis of rotation than detent 1*e* and so on. This allows the latching device 1 to secure threaded fastener assemblies separated by different distances. For example, in FIG. 1, detent 1*c* accommodates the first fastener assembly 5 and the second fastener assembly 6 separated by distance D1. In FIG. 2, detent 1*e* accommodates the first fastener assembly 5 and the second fastener assembly 6 separated by distance D2. In FIG. 3, detent 1*e* accommodates the first fastener assembly 5 and the second fastener assembly 6 separated by distance D3. Referring to FIGS. 1-3 and 5, the inside edge 1*h* of the slot, i.e., the edge of the slot closer to the rotational axis R, is shaped to clear the second fastener assembly 6 (FIGS. 1-3) as the latching device 1 rotates. For example, as illustrated in FIG. 5, the inside edge 1*h* of the slot 1*a* can follow a circular arc, or the arc of a cylinder, concentric with the rotational axis R represented by distance R1. Distance R1 must allow for enough space between detent 1*c* and the inside edge 1*h* of the slot 1*a* to rotate past the portion of the second fastener assembly 6 of FIG. 1 that contacts the detents 1*c*, 1*d*, 1*e*, 1*f*, 1*g*. Here, the portion of the second fastener assembly 6 that contacts the detents 1*c*, 1*d*, 1*e*, 1*f*, 1*g* is the spacer 13. While FIGS. 1-3 shows the latching device 1 with five detents, the inventor envisions that the latching device 1 can have fewer or more detents (i.e., two or more detents) to accommodate different design requirements. For example, a latching device 1 with more detents can accommodate a wider variation in mounting distances between the first fastener assembly 5 and the second fastener assembly 6. The detents illustrated are separated by equal increments and have equal angles. The inventor found shaping the outside edge so the detents follow a section of a spiral curve creates both equal angles and equal increments. The inventor envisions that the detents could also be separated by unequal increments or have unequal angular increments.

Referring to FIG. 4, the first fastener assembly 5 can include, for example, a threaded fastener 7, a spacer 8, and an insert 9. The insert body 9*a* passes through the first mounting hole 3*a* with the first splitboard ski 3 retaining the insert head 9*b*. The spacer 8 surrounds a portion of the insert body 9*a* that passes through the first splitboard ski 3. The spacer 8 can be clamped by the top of the first splitboard ski 3 to prevent rotation about the insert body 9*a*. The spacer 8 passes into an aperture 1*i* in the latching device 1. The aperture 1*i* is centered about the rotational axis R. The insert body 9*a* includes a threaded hollow interior 9*c*. The threaded body 7*a* of the threaded fastener 7 passes through the spacer 8 and threadedly engages the threaded hollow interior 9*c* of the insert body 9*a*. A threaded fastener head 7*b* rests against the bottom of a blind hole 1*j* surrounding the aperture 1*i*. The spacer 8 sets the height of the threaded fastener head 7*b* away from the first splitboard ski 3 to allow the latching device 1 to rotate, but provides sufficient friction so that the latching device 1 does not spin in touring mode.

Figure 7:
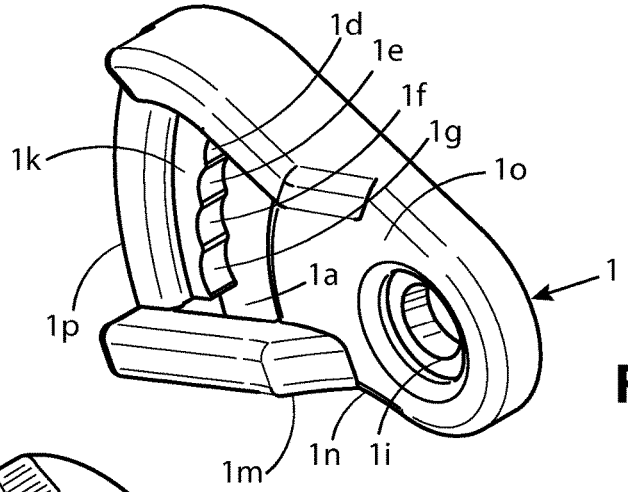
FIG. 7 illustrates a top and left perspective view of the latching device.
Figure 8:
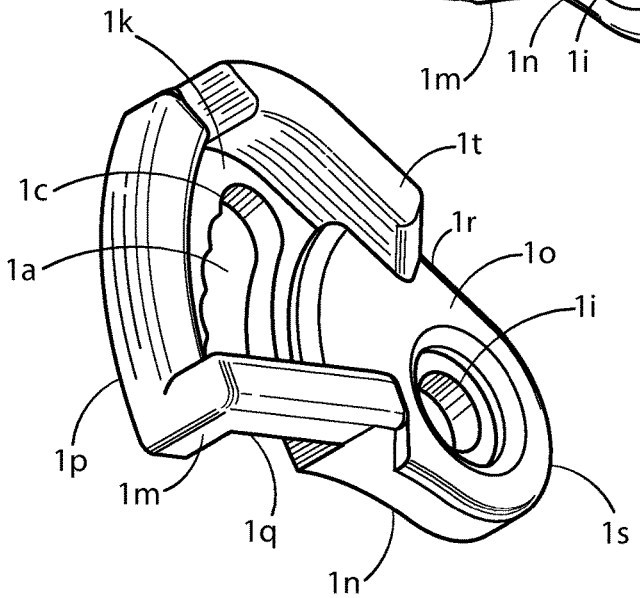
FIG. 8 illustrates a top and right perspective view of the latching device.

The second fastener assembly 6 can include, for example, a threaded fastener 10, a spacer 13, and an insert 16. The insert body 16*a* passes through the second mounting hole 4*a* with the second splitboard ski 4 retaining the insert head 16*b*. The spacer 13 surrounds a portion of the insert body 16*a* that passes through the second splitboard ski 4. The spacer 13 can be clamped by the threaded fastener 10 against the second splitboard ski 4 to prevent it from rotating. The spacer 13 sets the height of the threaded fastener head 10*b* away from the first splitboard ski 3 to constrain the second splitboard ski 4 from moving up and down vertically. The insert body 16*a* includes a threaded hollow interior 16*c*. The threaded body 10*a* of the threaded fastener 10 passes through the spacer 13 and threadedly engages the threaded hollow interior 16*c* of the insert body 16*a*. Referring to FIG. 1, the outside surface of the spacer 13 engages the outside edge 1*b* of the slot 1*a* and the detents 1*c*, 1*d*, 1*e*, 1*f* when the latching device 1 is rotated. One purpose of the spacer 13 is to protect the threads of the threaded fastener 10 from damage and protect the surface of the outside edge 1*b* from the threaded fastener 10. Referring to FIG. 4, a threaded fastener head 10*b* rests against a slot surrounding surface 1*k*. The slot surrounding surface 1*k* is also shown in FIGS. 5, 7, and 8. The inventor envisions other arrangements where a spacer may not be required. For example, the threaded fastener 10 could be a shoulder bolt, or other type of screw or bolt where the portion nearest the threaded fastener head 10*b* is unthreaded.

Referring to FIGS. 1, 5, and 7, the detents 1*d*, 1*e*, 1*f*, 1*g*, and detent 1*c* of FIGS. 1 and 5, can be shaped like the arc of a cylinder with the same radius of the detent engaging portion of the second fastener assembly 6. For example, the detent engaging portion can be as outside surface of the spacer 13 (FIG. 1). Here, the detent engaging portion (i.e., the spacer 13 (FIG. 1) is complementary in shape with the detents 1*d*, 1*e*, 1*f*, 1*g*. The inventor found this size and shape creates sufficient holding force so the latch does not slip or unlatch during normal operation of a splitboard while still allowing the splitboard rider to rotate the latching device. The inventor envisions that other detent shapes can be used if they can prevent the latch from slipping or unlatching during normal operation of the splitboard 2 (FIG. 1) but still allow the splitboard rider to unlatch the splitboard 2.

Figure 6:
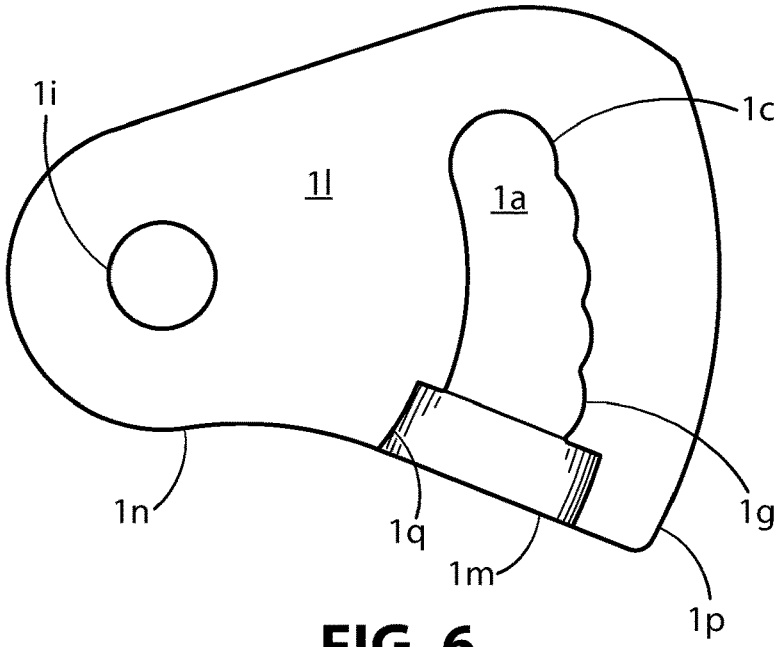
FIG. 6 illustrates the latching device in bottom view.
Figure 9:
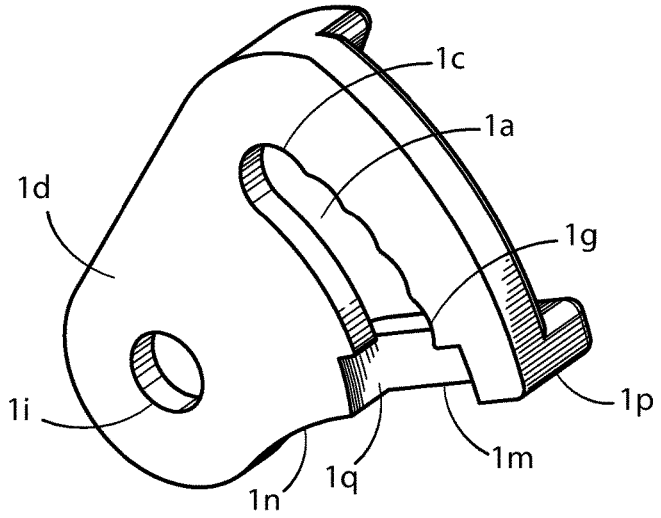
FIG. 9 illustrates a bottom perspective view of the latching device.

Referring to FIGS. 6 and 9, the bottom surface 1*l* of the latching device 1 can be smooth or planar to allow the splitboard rider to rotate the latching device 1 along the surface of the splitboard of FIGS. 1, 2, and 3. The inventor envisions using other surfaces that can also allow for the splitboard rider to rotate the latching device 1 without damaging either the splitboard 2 of FIGS. 1, 2, and 3 or the latching device 1, for example, a ribbed surface.

Figure 13:
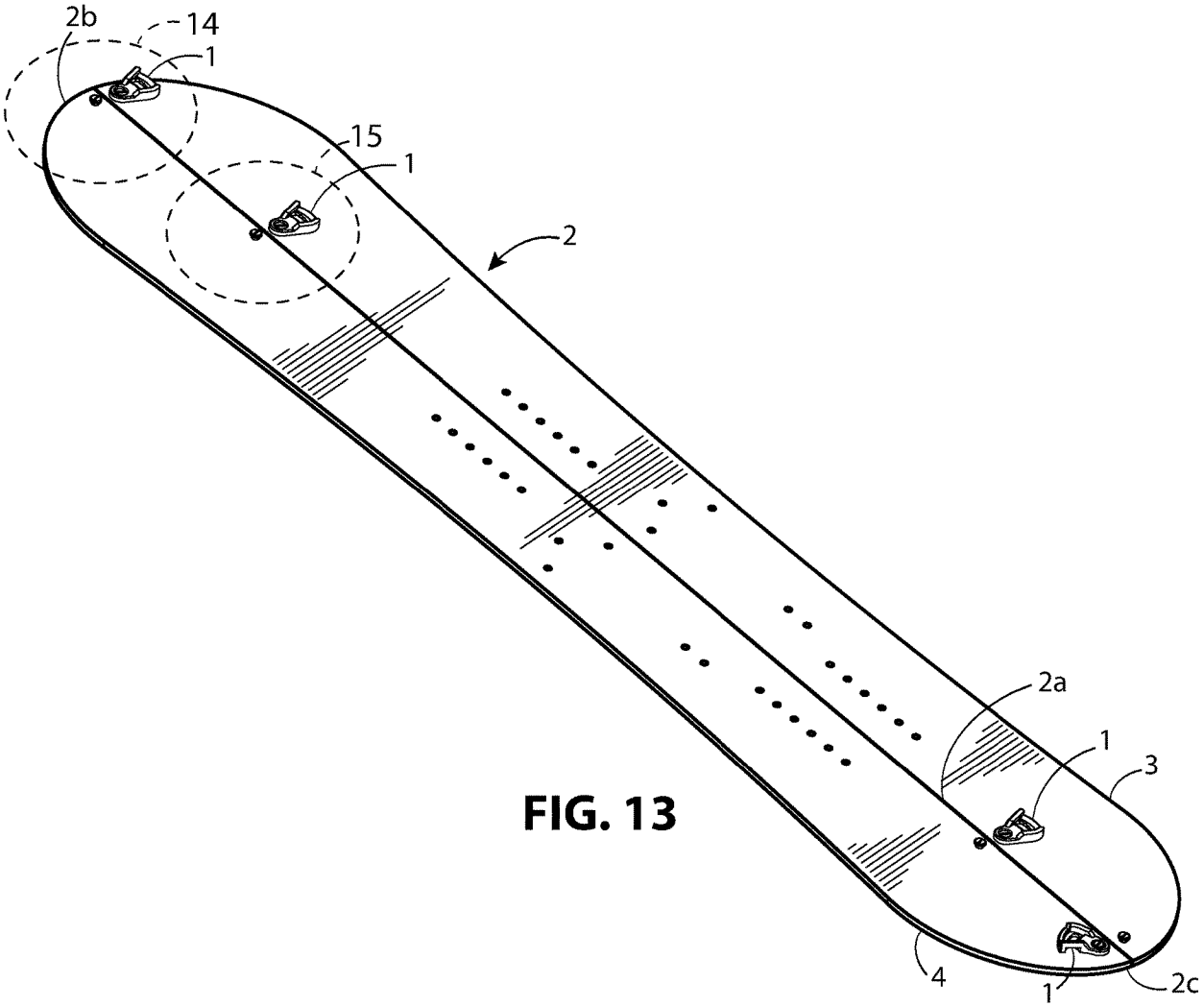
FIG. 13 illustrates, in top perspective view, the splitboard of FIG. 10 with the latching devices in touring mode.
Figure 15:
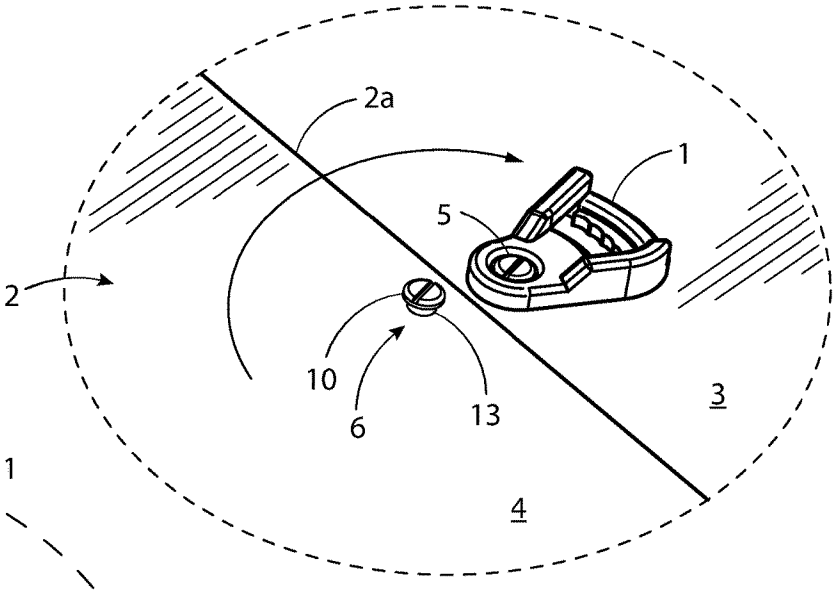
FIG. 15 illustrates an enlarged partial view of FIG. 13 showing the latching device that is positioned at an intermediate position along the lengthwise common edge.
Figure 14:
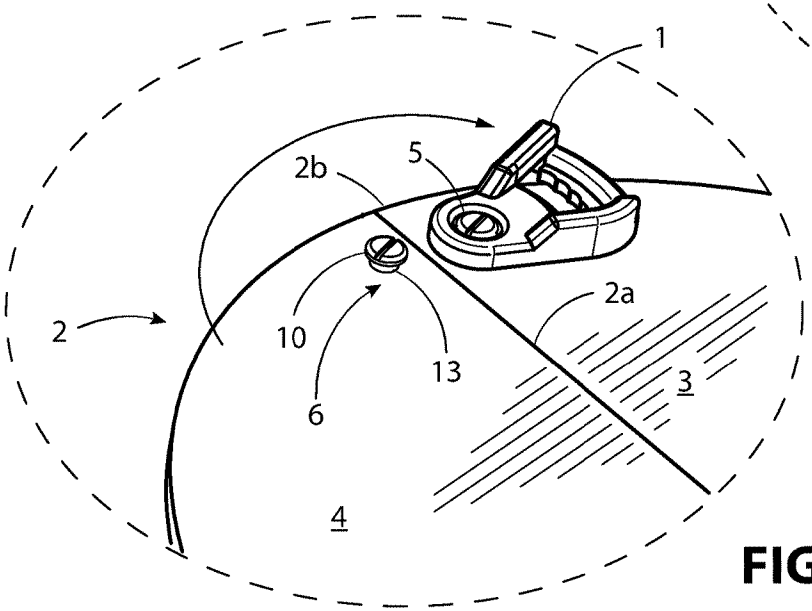
FIG. 14 illustrates an enlarged partial view of FIG. 13 showing the latching device that is positioned near the tip of splitboard.

Referring to FIGS. 6, 8, and 9 the slot 1*a* extends from the detent 1*c* through the side of the latching device 1 opposite the detent 1*c* (i.e., the side of the latching device nearest slot 1*a* shown in FIGS. 6 and 9). This allows the latching device 1 to rotate from a latched position to an unlatched position. The unlatched position is illustrated in FIGS. 13-15. Referring to FIGS. 5-9, the slot 1*a* extends through a first side portion 1*m*. The first side portion 1*m* projects upward from a first side 1*n*. The first side portion 1*m* provides mechanical support to the latching device 1 by bridging between a top surface 10 (FIGS. 5, 7, and 8) of the latching device 1 and a second side 1*p*. The second side 1*p* is outwardly located on the opposite of the slot 1*a* from the aperture 1*i*. The splitboard rider can use the first side portion 1*m* as a handle for rotating the latching device 1. FIGS. 6, 8, and 9 illustrate the slot 1*a* extending through an aperture 1*q* in the second side portion.

Referring to FIGS. 5 and 8, latching device 1 can include a third side 1*r*. The third side is located on the opposite side of the slot 1*a* and aperture 1*i* as the first side 1*n*. The latching device 1 includes a fourth side 1*s* on the opposite side of the slot 1*a* and aperture 1*i* as the second side 1*p*. The fourth side portion 1*s* can be radiused around the aperture 1*i*. This presents a smooth edge to the outside environment. However, the fourth side portion 1*s* can be any shape. The third side 1*r* can include a third side portion 1*t* that projects upward from the third side 1*r*. The third side portion 1*t* is located on the opposite side of the slot from the first side 1*m* and can add additional stability to the latching device. The splitboard rider can use the third side portion 1*t* as a handle for rotating the latching device 1.

Referring to FIG. 8, the slot surrounding surface 1*k* can be indented from the top surface 10 and the second side 1*p*. This raises up the first side portion 1*m* and the third side portion 1*t* so the splitboard rider has a convenient place to grasp, push, or pull on the latching device to rotate it even while wearing gloves. It is well within the scope of a latching device 1 to have the slot surrounding surface 1*k* not indented from the top surface or the second side 1*p*.

Figure 10:
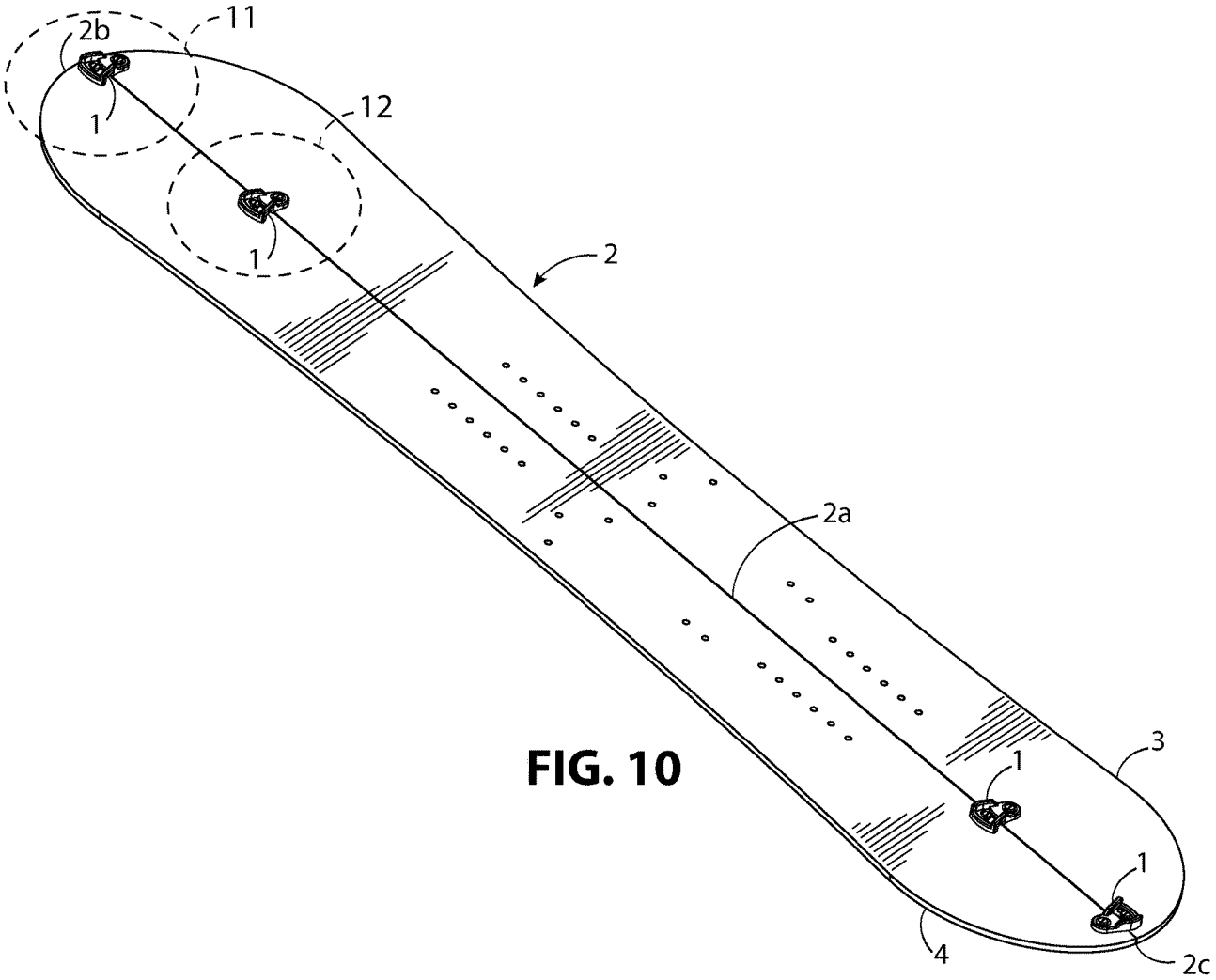
FIG. 10 illustrates in top perspective view, a splitboard in riding mode with latching devices positioned at the tip, tail, and intermediate positions along the lengthwise common edge between the splitboard skis.
Figure 12:
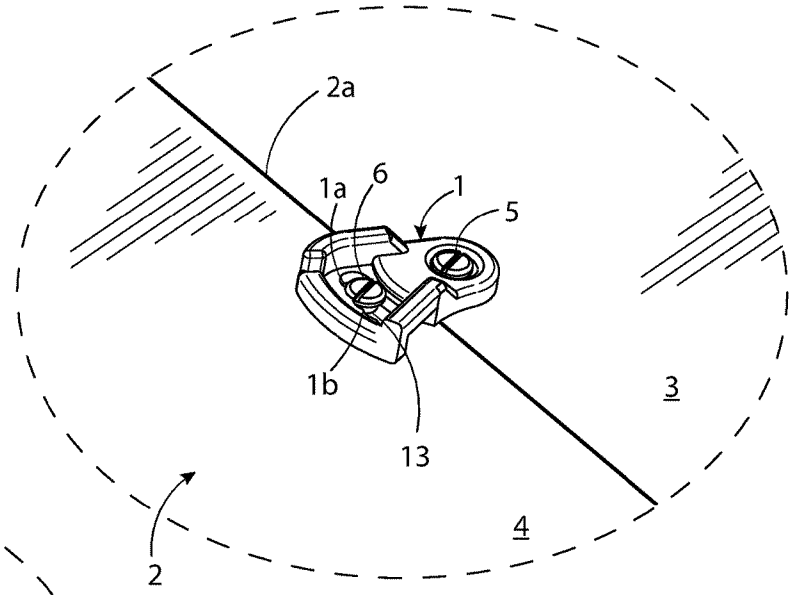
FIG. 12 illustrates an enlarged partial view of FIG. 10 showing the latching device that is positioned at an intermediate position along the lengthwise common edge.
Figure 11:
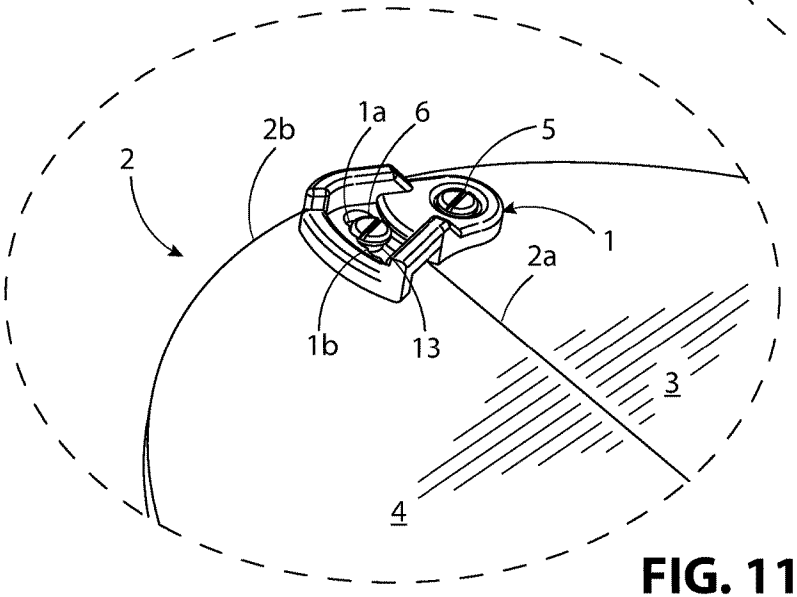
FIG. 11 illustrates an enlarged partial view of FIG. 10 showing the latching device that is positioned near the tip of splitboard.

FIGS. 10-15 illustrate latching devices 1 positioned in various locations along the lengthwise common edge 2*a* the splitboard 2. FIG. 10 illustrates in top perspective view, a splitboard 2 in riding mode with the latching devices 1 at the tip 2*b*, tail 2*c*, and intermediate positions along the lengthwise common edge 2*a* between the first splitboard ski 3 and the second splitboard ski 4. FIG. 11 illustrates an enlarged partial view of FIG. 10 showing the latching device that is positioned near the tip 2*b* of splitboard 2 along the lengthwise common edge 2*a* between the first splitboard ski 3 and the second splitboard ski 4. FIG. 12 illustrates an enlarged partial view of FIG. 10 showing the latching device 1 that is positioned at an intermediate position along the lengthwise common edge 2*a* between the first splitboard ski 3 and the second splitboard ski 4. FIGS. 11 and 12 show the spacer 13 of the second fastener assembly 6 engaging the outside edge 1*b* of the slot 1*a*.

FIGS. 13-15, illustrate the latching device 1 rotated clockwise and unlatched away from the second splitboard ski 4 and completely within the boundary of the first splitboard ski 3. FIG. 13 illustrates, in top perspective view, the splitboard 2 of FIG. 10 with the latching device 1 rotated and unlatched for touring mode. FIG. 14 illustrates an enlarged partial view of FIG. 13 showing the latching device 1 that is positioned near the tip 2*b* of splitboard 2. FIG. 15 illustrates an enlarged partial view of FIG. 13 showing the latching device 1 that is positioned at an intermediate position along the lengthwise common edge 2*a* of the splitboard 2. In FIGS. 14 and 15 the latching device 1 is illustrated rotated clockwise about the first fastener assembly 5 onto the first splitboard ski 3 with the second fastener assembly 6 along, threaded fastener 10, and spacer 13 free of the latching device 1. Referring to FIGS. 1, 2, 3, and 8 the latching device 1 is rotated clockwise from slot 1*c* to slot g (FIGS. 1-3) and through the aperture 1*q* in the first side portion 1*m* (both of FIG. 8) to the position in FIGS. 13-15. The latching device could also be constructed to rotate counterclockwise to unlatch by mirroring the construction of the both the slot 1*a*, the first side portion 1*m* and the aperture 1*q*.

This disclosure describes a device for latching splitboard skis. This disclosure does not intend to limit the claimed invention to the examples, variations, and exemplary embodiments described in the specification. Those skilled in the art will recognize that variations will occur when embodying the claimed invention in specific implementations and environments. For example, in FIGS. 1-15, the latching device 1 is pictured as wedged shaped with two sides radiused about the rotational axis R (FIG. 5). This shape allows for ease of manufacturing and allows for many placement positions along a splitboard or other joining surfaces. However, this disclosure does not intend to limit the invention to the shape depicted. Other shapes may be within the scope of the latching device.

The fastener assemblies described in this disclosure can include a threaded fastener and several other components, for example an insert and a spacer. However, other combinations of components are within the scope of the meaning of a fastener assembly. For example, the fastener assembly can include rivets or rivets combined with spacer instead of threaded fasteners and inserts. The fastener assembly may include only a threaded fastener that fastens directly into the splitboard or another mounting surface. A threaded fastener may include a threaded fastener with an insert but without a spacer. These combinations are all within the scope of this disclosure. A threaded fastener can be any threaded fastener within the ordinary meaning of the word that can perform the functions specified within this disclosure. For example, a screw, or bolt. Threaded fasteners in the Description are often depicted with slot heads. However, any tool receiving head that can perform the function of a threaded fastener with the latching device 1 may be readily used. For example, hexagonal recess or "Allen" heads, Philips, Frearson, clutch, square recess, tri-wing, a recessed star pattern often sold under the registered trademark TORX® by Textron Industries, Inc, and other tool receiving heads known in the art can be readily substituted. The first fastener assembly and the second fastener assembly can be structured differently from each other. For example, the first fastener assembly could include a threaded fastener, a spacer, and an insert. While the second fastener assembly could include an insert and a standoff. Similarly, the first fastener assembly could include a rivet or a rivet and a spacer. The second could include a standoff with an insert. These combinations and other combinations of the fastener assembly variations are well within the scope of this disclosure. The detent engaging portion of the fastener assembly can be any portion of the fastener assembly that engages the detents. For example, the detent engaging portion can be the spacer. The detent engaging portion can be body of a rivet. The detent engaging portion can be the non-threaded portion of a shoulder bolt, standoff, or other non-threaded portion of a threaded fastener.

The latching device can be constructed of any material capable of performing the function intended for the latching device. For example, for splitboarding applications, the latching device can be made of any material capable of withstanding the temperature changes from indoor to extreme cold weather encountered with splitboarding and can hold up to the forces put upon in both touring and riding modes. For example, for splitboarding, the latching device can be readily made from nylon, acrylonitrile butadiene styrene (ABS), thermoplastics or similar materials.

The appended claims are not to be interpreted as including means-plus-function limitations, unless a claim explicitly evokes the means-plus-function clause of 35 USC § 112(f) by using the phrase "means for" followed by a verb in gerund form.

A "method" as disclosed herein refers to one or more steps or actions for achieving the described end. Unless a specific order of steps or actions is required for proper operation of the embodiment, the order and/or use of specific steps and/or actions may be modified without departing from the present invention.

"Optional" or "optionally" is used throughout this disclosure to describe features or structures that are optional. Not using the word optional or optionally to describe a feature or structure does not imply that the feature or structure is essential, necessary, or not optional. Using the word "or," as used in this disclosure is to be interpreted as the ordinary meaning of the word "or" (i.e., an inclusive or) For example, the phrase "A or B" can mean: (1) A, (2) B, (3) A with B.

While the examples and variations are helpful to those skilled in the art in understanding the claimed invention the claimed invention is defined solely by the claims and their equivalents.

What is claimed is:

1. A device for latching a first splitboard ski and a second splitboard ski, a first fastener assembly secured to the first splitboard ski and a second fastener assembly secured to the second splitboard ski, and a lengthwise common edge between the first splitboard ski and the second splitboard ski, comprising:

a latching device including an aperture, a first side, and a slot;

the aperture is centered about a rotational axis of the latching device and is rotationally coupled to the first splitboard ski;

the first side is distanced away from the aperture;

the first side includes a first side portion bridging over an opening of the slot;

the slot is distanced away from the aperture and extends through the first side below the first side portion;

the slot includes an outside edge with two or more detents; and the two or more detents each successively engage the second fastener assembly progressively closer to the rotational axis and away from the first side.

2. The device of claim 1, wherein:

the slot is so shaped and positioned so the second fastener assembly can successively engage each successive detent of the two or more detents and pass through the first side below the first side portion as the latching device is rotated.

3. The device of claim 2, wherein:

the second fastener assembly includes a detent engaging portion; and each detent of the two or more detents is complementary in shape as the detent engaging portion.

4. The device of claim 2, wherein the two or more detents are positioned along a section of a spiral curve.

5. The device of claim 2, wherein each detent of the two or more detents is shaped as an arc of a cylinder.

6. The device of claim 1, wherein:

the second fastener assembly includes a detent engaging portion; and each detent of the two or more detents is complementary in shape as the detent engaging portion.

7. The device of claim 1, wherein the outside edge is a section of a spiral curve.

8. The device of claim 1, wherein each detent of the two or more detents is shaped as an arc of a cylinder.

9. The device of claim 1, wherein:

the slot includes an inside edge radially closer to the rotational axis than the outside edge; and the inside edge is so shaped as to allow the second fastener assembly to successively engage each successive detent of the two or more detents and pass through the first side below the first side portion as the latching device is rotated.

10. The device of claim 1, wherein:

the slot includes an inside edge radially closer to the rotational axis than the outside edge with the inside edge following a circular radius.

11. The device of claim 1, wherein:

the two or more detents each successively engage the second fastener assembly progressively closer to the rotational axis and away from the first side causing progressively greater compression at the lengthwise common edge.

12. A device for latching a first splitboard ski and a second splitboard ski, a first fastener assembly secured to the first splitboard ski and a second fastener assembly secured to the second splitboard ski, and a lengthwise common edge between the first splitboard ski and the second splitboard ski, comprising:

a latching device including an aperture, a first side, and a slot;

the aperture is centered about a rotational axis of the latching device and is rotationally coupled to the first splitboard ski;

the first side is distanced away from the aperture;

the first side includes a first side portion projecting upward from the first side and bridging over an opening of the slot;

the slot is distanced away from the aperture and extends through the first side below the first side portion;

the slot includes an outside edge with two or more detents; and the two or more detents each successively engage the second fastener assembly progressively closer to the rotational axis and away from the first side.

13. The device of claim 12, wherein:

the slot is so shaped and positioned so the second fastener assembly can successively engage each successive detent of the two or more detents and pass through the first side below the first side portion as the latching device is rotated.

14. The device of claim 12, wherein:

the two or more detents each successively engage the second fastener assembly progressively closer to the rotational axis and away from the first side causing progressively greater compression at the lengthwise common edge.

15. The device of claim 12, wherein:

the slot includes an inside edge radially closer to the rotational axis than the outside edge; and the inside edge is so shaped as to allow the second fastener assembly to successively engage each successive detent of the two or more detents and pass through the first side below the first side portion as the latching device is rotated.

16. The device of claim 12, wherein:

the slot includes an inside edge radially closer to the rotational axis than the outside edge with the inside edge following a circular radius.

17. The device of claim 12, wherein:

the second fastener assembly includes a detent engaging portion; and each detent of the two or more detents is complementary in shape as the detent engaging portion.

* * * * *